US007003257B2

(12) United States Patent
Yoshie et al.

(10) Patent No.: US 7,003,257 B2
(45) Date of Patent: Feb. 21, 2006

(54) HOLE-PUNCHING PROCESSOR AND IMAGE FORMING APPARATUS

(75) Inventors: Kohji Yoshie, Hachioji (JP); Hisao Hosoya, Hachioji (JP); Masanobu Kawano, Hachioji (JP); Hideyo Ohashi, Miyoshi-machi (JP); Kazuyoshi Omi, Kawagoe (JP); Masaru Goto, Tokyo (JP); Tomoki Nagaoka, Kodaira (JP); Kazuaki Fukuda, Kawagoe (JP)

(73) Assignee: Konica Corporation, Tokyo (JP)

( * ) Notice: Subject to any disclaimer, the term of this patent is extended or adjusted under 35 U.S.C. 154(b) by 539 days.

(21) Appl. No.: 10/033,073

(22) Filed: Dec. 26, 2001

(65) Prior Publication Data

US 2002/0079640 A1 Jun. 27, 2002

(30) Foreign Application Priority Data

Dec. 27, 2000 (JP) ..... 2000-397750
Dec. 27, 2000 (JP) ..... 2000-397754
Dec. 27, 2000 (JP) ..... 2000-397756

(51) Int. Cl.
*G03G 15/00* (2006.01)

(52) U.S. Cl. ..... 399/389; 399/408

(58) Field of Classification Search ..... 399/389, 399/407, 408; 270/58.08, 58.09
See application file for complete search history.

(56) References Cited

U.S. PATENT DOCUMENTS 3,955,454 A * 5/1976 Copp ..... 83/368
4,789,903 A * 12/1988 Kamada et al. ..... 358/296
5,182,861 A * 2/1993 Suzuki et al. ..... 33/18.1
6,430,382 B1 * 8/2002 Okamoto et al. ..... 399/82

* cited by examiner

*Primary Examiner*—Ren Yan
(74) *Attorney, Agent, or Firm*—Lucas & Mercanti LLP

(57) ABSTRACT

The invention concerns a hole-punching processor that forms punched-holes, for binding sheets into a file, on the sheets, which are ejected after images are formed on them from an image forming apparatus such as, for example, a copying machine, a printer, a facsimile machine or a compound machine thereof. The hole-punching processor forms a punched-hole on a sheet residing in a conveying path for conveying the sheet through the hole-punching processor. The hole-punching processor includes a hole-punching device being movable in a direction perpendicular to a conveyance direction of the sheet and a sheet-edge detector to detect a side-edge of the sheet in a direction parallel to the conveyance direction of the sheet. The hole-punching device moves with the sheet-edge detector to a center of the sheet, based on positional information of the side-edge detected by the sheet-edge detector, to punch a hole in the sheet.

12 Claims, 14 Drawing Sheets

HOLE-PUNCHING PROCESSOR AND IMAGE FORMING APPARATUS

BACKGROUND OF THE INVENTION

The present invention relates to a hole-punching processor and an image forming apparatus, and in particular, to a hole-punching processor that forms a punched-hole for file binding on a sheet that is subjected to image forming and recording by an image forming apparatus such as, for example, a copying machine, a printer, a facsimile machine or a compound machine thereof and is ejected, and to an image forming apparatus equipped with the hole-punching processor.

In an image forming apparatus such as a copying machine, a printer, a facsimile machine or a compound machine thereof, there has been made an attempt to improve work efficiency by combining a hole-punching processor that forms a punched-hole for file binding with an image forming apparatus.

In processing of this punched-hole, it is important that punching is conducted at the same position constantly so that a position of a punched-hole may not be deviated on a sheet and the sheet may be trued up satisfactorily when the sheet is filed. However, a position of a punched-hole on each sheet is varied slightly by generation of sheet skewing or of a one-sided sheet in conveyance of each sheet, and thereby, positions of punched-holes turn out to be irregular even when edges of sheets having thereon punched-holes are trued up, thus, the sheets cannot be filed together, or edges of the sheets turn out to be irregular and awkward even if they can be filed, which has been a problem.

With the background stated above, there has been proposed a technology wherein a line sensor is arranged at the position corresponding to the width of a sheet that is led into a hole-punching device, and a position of a side edge of the sheet that is in parallel with the conveyance direction for the sheet is detected by the sensor, then, based on the result of the detection, the hole-punching device itself is moved in the direction of a width of the sheet so that a hole may be punched at the center of the sheet in its width direction (TOKKAIHEI No. 3-92299).

However, the line sensor needs to be provided to correspond to the sheet size, resulting naturally in a large size, and a problem of cost increase by an amount equivalent to the increase in size cannot be avoided.

On the other hand, there has been proposed a technology wherein a detecting means itself for detecting, corresponding to a width of a sheet to be led into a hole-punching device, a position of a side edge that is in parallel with the conveyance direction for the sheet is moved in the direction of a width of the sheet independently of the hole-punching device (TOKKAIHEI No. 10-279170).

The technology stated above makes it unnecessary to use a line sensor, and the aforesaid problem can be solved accordingly. However, it is impossible to avoid the problems that an apparatus grows greater and cost is increased, because a moving mechanism for the exclusive use for moving the detecting means and a driving means therefore are necessary.

There has further been proposed a technology wherein a hole-punching device is provided movably in the direction perpendicular to the conveyance direction for a sheet, and a side edge detection sensor (photo-sensor) for detecting a position of the side edge that is in parallel with the conveyance direction for the sheet to be led into the hole-punching device, and the side edge detection sensor is moved in the direction of the sheet width perpendicular to the conveyance direction for the sheet to detect a position of the side edge of the sheet, then, the hole-punching device is moved to the center of the sheet based on information of the detection results for hole-punching processing (TOKKAIHEI No. 10-279170).

In the hole-punching processor stated above, a sheet is ejected with its image surface facing downward because sheets are subjected to paginating in the order of outputting from the image forming apparatus main body and are stacked on a sheet ejection tray. However, when hole-punching processing is conducted on sheets conveyed in from the image forming apparatus main body, the hole-punching processing is usually conducted on the trailing edge portion in the conveyance direction. Therefore, it is necessary to form a conveyance path that conveys the leading edge of a sheet at the downstream side of the hole-punching device that punches a punched-hole. However, for avoiding a large-sized hole-punching processor, the aforesaid conveyance path is composed of a curved path in a shape of a curve so that a long conveyance path may be secured and an apparatus in a small size may be attained by narrowing the width as far as possible.

The hole-punching processor mentioned above makes it possible to correct skewing for sheets in various sizes fed in from the image forming apparatus main body, and then, to conduct hole-punching processing on the trailing edge of the sheet.

However, it is problematic in terms of conveyance reliability to convey a sheet like a thick sheet on which hole-punching processing cannot be conducted by using a conveyance path composed of a curved path. Further, when conducting hole-punching processing for the sheet that is short in size and is conveyed in from the image forming apparatus main body, or even when hole-punching processing is not conducted for a sheet, the sheet must be ejected through a longer distance, and the waiting time up to sheet ejection for the sheet is longer, which is a disadvantage to cause a decline in FCOT (First Copy Time) efficiency.

Further, for enhancing functions of an image forming apparatus more in general, there sometimes is an occasion to connect, in succession to a hole-punching processor, a finishing apparatus including a stapler that conducts staple processing for the sheet ejected from the hole-punching processor.

In the hole-punching processor, when a sheet is subjected to correction of skewing and to hole-punching processing, the preceding sheet that is being conveyed in the hole-punching processor is usually stopped temporarily each time, because driving of a conveyance motor is stopped temporarily to stop conveyance of the sheet temporarily. Therefore, when a leading edge of the sheet that is conveyed from an outlet of the hole-punching processor into the finishing apparatus in the subsequent step is in the state to be nipped by an entrance roller of the finishing apparatus, if the conveyance roller of the hole-punching processor is stopped temporarily, there is caused a phenomenon that the rotating entrance roller on the finishing apparatus side and the conveyance roller on the hole-punching processor side which is at a standstill pull the sheet each other, resulting in a problem that the sheet is soiled.

SUMMARY OF THE INVENTION

The invention has been achieved in view of the circumstances in the past, and its first object is to provide a hole-punching processor which can conduct hole-punching processing at the central position in the lateral direction of a sheet accurately, and is simple in structure, small in size and can be structured at low cost.

The second object of the invention is to provide an image forming apparatus equipped with a hole-punching processor which can conduct hole-punching processing at the central position in the lateral direction of a sheet accurately, and is simple in structure, small in size and can be structured at low cost.

For the prompt detection of a position of the side edge of a sheet, it is preferable that a detection sensor for the side edge that detects a position of the side edge of a sheet is positioned in the vicinity of the side edge of the sheet that is conveyed toward a hole-punching processor in advance to be on standby.

However, if the detection sensor for the side edge is positioned in the vicinity of the side edge of the sheet to be on standby, sheet jamming (jam) tends to be caused especially in the course of hole-punching processing wherein the detection sensor for the side edge does not move, which represents troubles. The reason for this is as follows. Guide plates are usually arranged vertically to sandwich a conveyance path for a sheet, in order to lead the sheet smoothly to the hole-punching device, and the detection sensor for the side edge is arranged so that its sensor light is projected toward the sheet through a sensor hole provided on the guide plate. Under these circumstances, if the detection sensor for the side edge is positioned in the vicinity of the side edge of the sheet, the sensor hole provided on the guide plate is also positioned to be close to the side edge of the sheet, and therefore, a corner section of the leading edge of the sheet that is conveyed to the hole-punching device tends to be caught by the sensor hole.

The third object of the invention, therefore, is to provide a hole-punching processor wherein sheet jamming in the course of non-hole-punching processing is not generated and reliability of sheet conveyance is improved.

Further, the fourth object of the invention is to provide an image forming apparatus equipped with a hole-punching processor wherein sheet jamming in the course of non-hole-punching processing is not generated and reliability of sheet conveyance is improved.

In addition, the fifth object of the invention is to provide a hole-punching processor capable of ejecting, appropriately and quickly, the sheet that is conveyed from the image forming apparatus main body, depending on the size of the sheet and on whether the hole-punching processing is needed or not, and to provide an image forming apparatus equipped with the aforesaid hole-punching processor.

Further, the sixth object of the invention is to provide a hole-punching processor that can eject the sheet smoothly without pulling it each other with a finishing apparatus when the sheet is stopped temporarily in the case of hole-punching processing, even when the finishing apparatus is connected, and to provide an image forming apparatus equipped with the aforesaid hole-punching processor.

Accordingly, to overcome the cited shortcomings, the abovementioned objects of the present invention can be attained by hole-punching processors and image-forming apparatus described as follow.

(1) A hole-punching processor for forming a punched-hole on a sheet residing in a conveying path for conveying the sheet through the hole-punching processor, comprising: a hole-punching device being movable in a direction perpendicular to a conveyance direction of the sheet; and a sheet-edge detector to detect a side-edge of the sheet in a direction parallel to the conveyance direction of the sheet; wherein the hole-punching device moves with the sheet-edge detector to a center of the sheet, based on positional information of the side-edge detected by the sheet-edge detector, to punch a hole in the sheet.

(2) The hole-punching processor of item 1, wherein a plurality of sheet-edge detectors, each of which corresponds to each of sheet sizes to be processed by the hole-punching processor, are provided.

(3) The hole-punching processor of item 1, wherein the sheet-edge detector is disposed in a vicinity of either an inner or an outer portion of the side-edge of the sheet, and, after a leading edge of the sheet is detected, the hole-punching device moves in either an inner or an outer direction perpendicular to the conveyance direction of the sheet so that the sheet-edge detector detects a position of the side-edge of the sheet.

(4) The hole-punching processor of item 3, wherein the sheet-edge detector also serves as a detector for detecting the leading-edge of the sheet.

(5) The hole-punching processor of item 4, wherein a plurality of sheet-edge detectors, each of which corresponds to each of sheet sizes to be processed by the hole-punching processor, are provided, and one of the sheet-edge detectors, which is disposed at a position nearest to a center of the sheet, detects the leading-edge of the sheet.

(6) The hole-punching processor of item 1, further comprising: a trailing-edge detector to detect a trailing-edge of the sheet being conveyed; wherein an action for conveying the sheet is temporarily deactivated, when the sheet has moved for a predetermined distance since the trailing-edge detector detected the trailing-edge of the sheet.

(7) The hole-punching processor of item 6, wherein the sheet-edge detector also serves as the trailing-edge detector.

(8) The hole-punching processor of item 7, wherein a plurality of sheet-edge detectors, each of which corresponds to each of sheet sizes to be processed by the hole-punching processor, are provided, and one of the sheet-edge detectors, which is disposed at a position nearest to a center of the sheet, detects the trailing-edge of the sheet.

(9) An image-forming apparatus, comprising: an image-forming section to form an image on a sheet; an ejecting section to eject the sheet on which the image is formed; and a hole-punching processor to form a punched-hole on the sheet while conveying the sheet through the hole-punching processor; wherein the hole-punching processor comprises: a hole-punching device being movable in a direction perpendicular to a conveyance direction of the sheet; and a sheet-edge detector to detect a side-edge of the sheet in a direction parallel to the conveyance direction of the sheet; and wherein the hole-punching device moves with the sheet-edge detector to a center of the sheet, based on positional information of the side-edge detected by the sheet-edge detector, to punch a hole in the sheet.

(10) A hole-punching processor of claim 1, wherein, in case of a non-punching mode in which a hole-punching action of the hole-punching device is deactivated, the sheet-edge detector is moved at a standby position located at either an inner or an outer position of the side-edge of the sheet so as to pass the sheet without punching.

(11) The hole-punching processor of item 10, wherein the hole-punching device moves with the sheet-edge detector.

(12) The hole-punching processor of item 10, wherein a plurality of sheet-edge detectors, each of which corresponds to each of sheet sizes to be processed by the hole-punching processor, are provided.

(13) The hole-punching processor of item 10, wherein the sheet-edge detectors comprises either a reflection-type or a transmission-type photo-sensor.

(14) An image-forming apparatus, comprising: an image-forming section to form an image on a sheet; an ejecting section to eject the sheet on which the image is formed; and a hole-punching processor to form a punched-hole on the sheet while conveying the sheet through the hole-punching processor; wherein the hole-punching processor comprises: a hole-punching device being movable in a direction perpendicular to a conveyance direction of the sheet; and a sheet-edge detector, being movable in a direction perpendicular to the conveyance direction of the sheet, to detect a side-edge of the sheet in a direction parallel to the conveyance direction of the sheet; and wherein the hole-punching device moves to a center of the side-edge, based on positional information of the side-edge detected by the sheet-edge detector, to punch a hole in the sheet; and wherein, in case of a non-punching mode in which a hole-punching action of the hole-punching device is deactivated, the sheet-edge detector is moved at a standby position located at either an inner or an outer position of the side-edge of the sheet so as to pass the sheet without punching.

(15) A hole-punching processor for forming a punched-hole on a sheet conveyed in a conveyance path from an image-forming apparatus, after a skew of the sheet is corrected by a registration roller, so as to eject the sheet from a ejecting section, comprising: a first conveyance path, being a short conveyance path and located downstream the registration roller, to directly convey the sheet to the ejecting section; a second conveyance path, being a long conveyance path and located downstream the registration roller, to convey the sheet in detour to the ejecting section; and a conveyance path switching section to selectively switch the conveyance path of the sheet to either the first conveyance path or the second conveyance path.

(16) A hole-punching processor of item 15, wherein the sheet is conveyed through the first conveyance path, switched by the conveyance path switching section, when a length of the sheet in parallel to a conveyance direction of the sheet is a short size, while the sheet is conveyed through the second conveyance path, switched by the conveyance path switching section, when a length of the sheet in parallel to a conveyance direction of the sheet is a long size.

(17) A hole-punching processor of item 15, wherein, in case of a non-punching mode in which an action for forming the punched-hole is deactivated, the conveyance path switching section switches the conveyance path of the sheet to the first conveyance path so that the sheet is conveyed trough the first conveyance path without correcting the skew of the sheet.

(18) A hole-punching processor of item 15, further comprising: a conveyance roller, disposed at the second conveyance path and driven by a first driving-force transmission section, to convey the sheet; an ejection roller, disposed at an outlet of both the first conveyance path and the second conveyance path, and driven by a second driving-force transmission section, to eject the sheet; and one-way rotating clutches to transmit a rotational driving-force in one rotational direction; wherein the one-way rotating clutches are incorporated in both the first driving-force transmission section and the second driving-force transmission section.

(19) An image-forming apparatus, comprising: an image-forming section to form an image on a sheet; a first ejecting section to eject the sheet on which the image is formed; and a hole-punching processor to form a punched-hole on the sheet conveyed in a conveyance path from the first ejecting section, after a skew of the sheet is corrected by a registration roller, so as to eject the sheet from a second ejecting section; wherein the hole-punching processor comprises: a first conveyance path, being a short conveyance path and located downstream the registration roller, to directly convey the sheet to the second ejecting section; a second conveyance path, being a long conveyance path and located downstream the registration roller, to convey the sheet in detour to the second ejecting section; and a conveyance path switching section to selectively switch the conveyance path of the sheet to either the first conveyance path or the second conveyance path.

Further, to overcome the abovementioned problems, other hole-punching processors and image-recording apparatus, embodied in the present invention, will be described as follow:

Structure (1)

A hole-punching processor which has therein a hole-punching device movable in the direction perpendicular to the conveyance direction for a sheet and a sheet side edge detection means that detects a position of the side edge which is in parallel with the conveyance direction for the sheet, and conducts hole-punching processing by moving the hole-punching device to the center of the sheet, wherein the sheet side edge detection means is provided to be capable of moving together with the hole-punching processor.

Structure (2)

The hole-punching processor described in Structure (1) wherein a plurality of sheet side edge detection means are provided, corresponding to a width of the sheet to be subjected to hole-punching processing.

Structure (3)

The hole-punching processor described in Structure (1) wherein the sheet side edge detection means is provided to be positioned in the vicinity of an inner side of the sheet side edge or of an outer side of the sheet side edge, and it detects a position of the sheet side edge by moving the hole-punching device to the vicinity of an inner side of the sheet or to the vicinity of an outer side of the sheet, after detecting the leading edge of the sheet conveyed thereto.

Structure (4)

The hole-punching processor described in Structure (3) wherein the sheet side edge detection means serves also as a means to detect the leading edge of the sheet.

Structure (5)

The hole-punching processor described in Structure (4), wherein a plurality of sheet side edge detection means are provided, corresponding to a width of the sheet to be subjected to hole-punching processing, and the leading edge of the sheet is detected by the detecting means closest to the center of the sheet.

Structure (6)

The hole-punching processor described in either one of Structures (1)–(5), wherein a sheet trailing edge detection means that detects the trailing edge of the sheet to be conveyed is provided, and conveyance of the sheet is stopped temporarily after the sheet is moved for a prescribed distance from the moment of detection of the sheet trailing edge.

Structure (7)

The hole-punching processor described in Structure (6), wherein the sheet side edge detection means serves also as the sheet trailing edge detection means.

Structure (8)

The hole-punching processor described in Structure (7), wherein a plurality of sheet side edge detection means are provided, corresponding to a width of the sheet to be subjected to hole-punching processing, and the trailing edge of the sheet is detected by the detecting means closest to the center of the sheet.

Structure (9)

An image forming apparatus wherein an image recording means that records and forms an image on a sheet and an ejection means that ejects a sheet on which an image is recorded and formed from the image recording means are provided, and hole-punching processing is conducted on the sheet ejected by the ejecting means by the hole-punching processor described in either one of Structures (1)–(8).

Structure (10)

A hole-punching processor having therein a side edge detection sensor that detects a position of the side edge being in parallel with the conveyance direction for a sheet, and conducting hole-punching processing at the center of the sheet by moving a hole-punching device in the direction perpendicular to the conveyance direction for the sheet, wherein the aforesaid side edge detection sensor is provided to be movable in the direction perpendicular to the conveyance direction for a sheet, and in the case of non-hole-punching processing, the side edge detection sensor is moved to be positioned to be inside or outside the position of the side edge that is in parallel with the conveyance direction for a sheet to be on standby, before the leading edge of the sheet arrives at the side edge detection sensor, so that the sheet may pass through.

Structure (11)

The hole-punching processor described in Structure (1) wherein the side edge detection sensor is provided to be movable together with the hole-punching device.

Structure (12)

The hole-punching processor described in Structure (1) or Structure (2) wherein a plurality of side edge detection sensors are provided to correspond to the width of a sheet to be subjected to hole-punching processing.

Structure (13)

The hole-punching processor described in Structure (1), (2) or (3) wherein the side edge detection sensor is a reflection-type or transmission-type photo-sensor.

Structure (14)

An image forming apparatus which has an image recording means that records and forms an image on a sheet and has an ejection means that ejects the sheet on which the image has been recorded and formed from the image recording means, and hole-punching processing is conducted on the sheet ejected by the ejection means by the hole-punching processor described in either one of Structures (1)–(4).

Structure (15)

A hole-punching processor that corrects skewing of the sheet that is fed in from the image forming apparatus main body by a registration roller, and then conducts hole-punching processing and ejecting, wherein there are provided a first conveyance path though which a sheet is conveyed and ejected out to the downstream side of the registration roller through a short conveyance path, a second conveyance path through which a sheet is conveyed and ejected out through a long conveyance path, and a switching means that switches selectively the conveyance path for the sheet to the first conveyance path or the second conveyance path.

Structure (16)

The hole-punching processor described in Structure (1), wherein the switching means switches so that a short sheet is conveyed through the first conveyance path and a long sheet is conveyed through the second conveyance path respectively, when conducting hole-punching processing.

Structure (17)

The hole-punching processor described in Structure (1), wherein the aforesaid switching guide member is switched to the first conveyance path for conveying without conducting correction operation for sheet skewing, in the case of non-hole-punching processing.

Structure (18)

The hole-punching processor described in Structure (1), (2) or (3), wherein each of the first and second conveyance paths has a conveyance roller and an ejection roller, and a one-way rotating clutch is used on the driving-force transmission section for the conveyance roller and the ejection roller.

Structure (19)

An image forming apparatus which has an image recording means that records and forms an image on a sheet and an ejection means that ejects the sheet on which the image has been recorded and formed from the image recording means, and conducts hole-punching processing on the sheet ejected by the ejection means with the hole-punching processor described in either one of Structures (1)–(4).

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
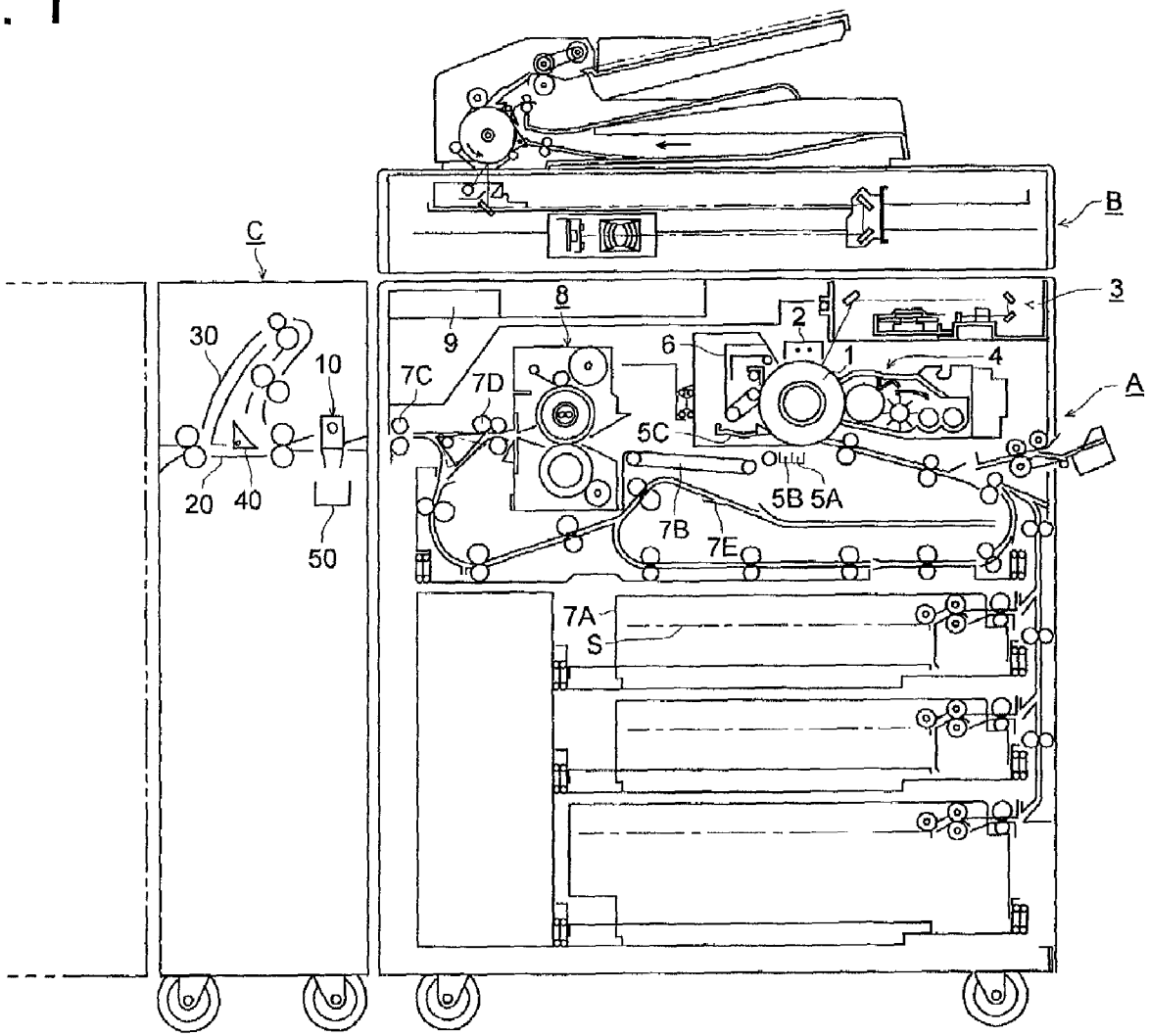
FIG. 1 is a structural diagram showing an outline of an image forming apparatus.

An embodiment of the invention will be explained as follows, referring to the drawings.

FIG. 1 is a general structural view showing an example of an image forming apparatus of the invention, and A represents the image forming apparatus main body, B represents an image reading apparatus, and C represents a hole-punching processor.

In the image forming apparatus main body A, charging means 2, image-wise exposure means (writing means) 3, developing means 4, transfer means 5A, neutralizing means 5B, separating claw 5C and cleaning means 6 are arranged around photoreceptor 1 representing a rotary image carrier, and after the surface of the photoreceptor 1 is charged evenly by the charging means 2, there is carried out laser beam scanning that is based on image data obtained from an original through reading by a laser beam of the image-wise exposure means 3 to form a latent image. The latent image is then subjected to reversal development conducted by the developing means 4, and thus, a toner image is formed on the photoreceptor 1.

On the other hand, sheet S representing a transfer sheet fed from sheet storage means 7A is conveyed to a transfer position. In the transfer position, the toner image is transferred onto sheet S by transfer means 5A. After that, charges on the reverse side of the sheet S are erased by neutralizing means 5B, and the sheet S is separated from photoreceptor 1 by separating claw 5C, and is conveyed by intermediate conveyance section 7B to be heated and fixed by fixing means 8, and is ejected out by ejection roller 7C.

When forming images on both sides of sheet S, the sheet S heated and fixed by fixing means 8 is diverged from an ordinary sheet ejection path by conveyance path switching and guiding member 7D, then, is switched back at reversal conveyance 7E to be reversed upside down, and is conveyed to the transfer position to be transferred, separated and fixed in the same way as in the obverse side, thus, the sheet S is ejected out of the apparatus by sheet ejection roller 7C. The sheet S ejected out of the image forming apparatus main body A by sheet ejection roller 7C is fed in hole-punching processor C provided to be adjacent to the image forming apparatus main body A.

On the other hand, developing agents remaining on the surface of photoreceptor 1 after image processing are removed by cleaning means 6 at the downstream side of the separating claw 5C, to make the photoreceptor 1 to be ready for the following image forming.

On the upper portion of the image forming apparatus main body A, there is provided image reading apparatus B that is equipped with an automatic original feeding unit of a moving original exposure type reading system.

The hole-punching processor C has therein hole-punching device 10 that receives a sheet ejected from sheet ejection roller 7C of the image forming apparatus main body A and punches and forms, on the trailing edge side in the conveyance direction, a punched-hole for binding in a file, first conveyance path 20 that conveys and ejects, through a shorter distance, the sheet on which a punched-hole has been punched and formed by the hole-punching device 10, and second conveyance path 30 that conveys and ejects through a longer distance, and these first conveyance path 20 and second conveyance path 30 are selectively switched by switching and guiding member 40.

Incidentally, punch dust receiver 50 that accepts punch dust is arranged under the hole-punching device 10.

Figure 2:
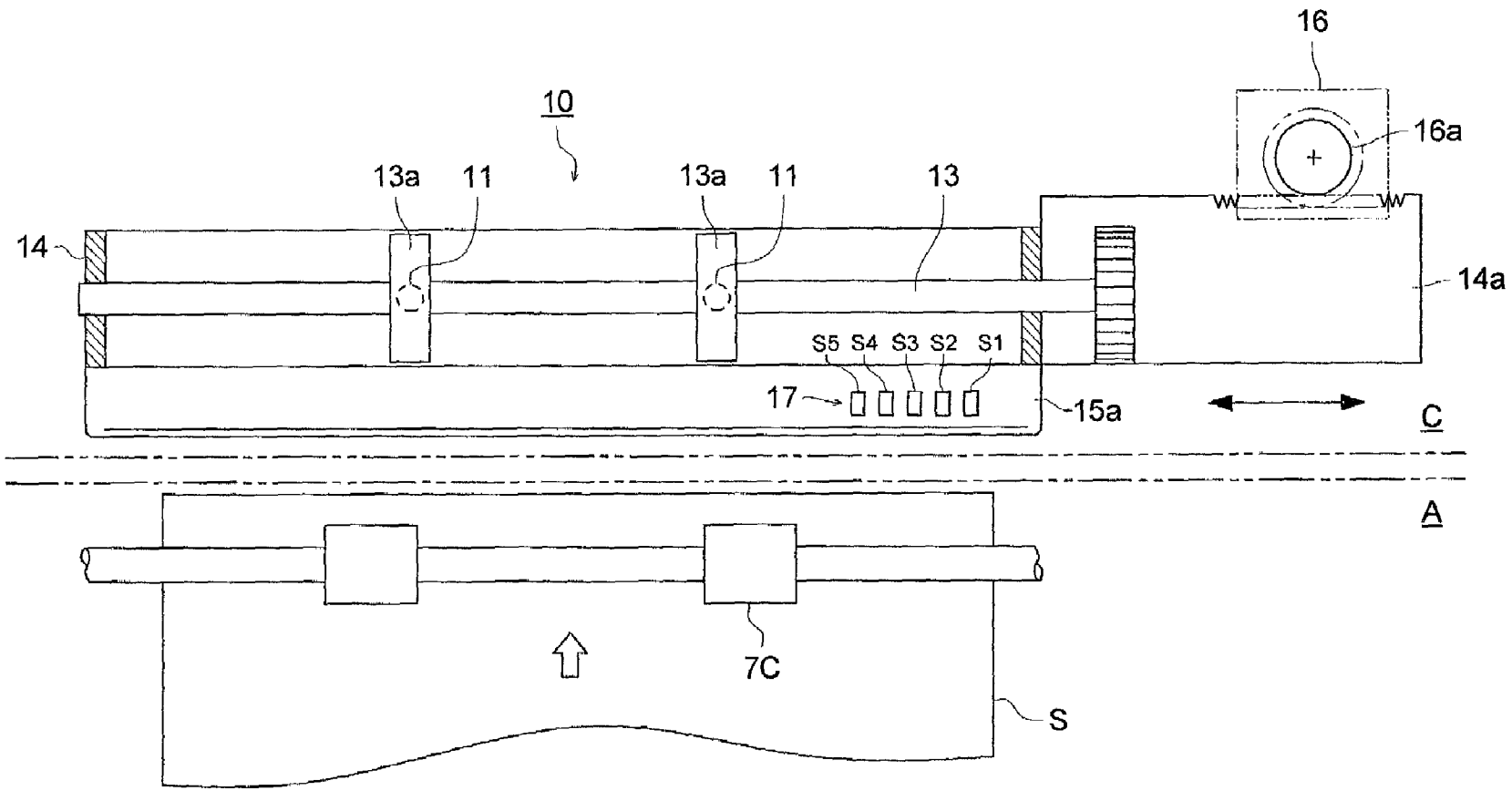
FIG. 2 is a top view showing a schematic structure of a hole-punching device.
Figure 3:
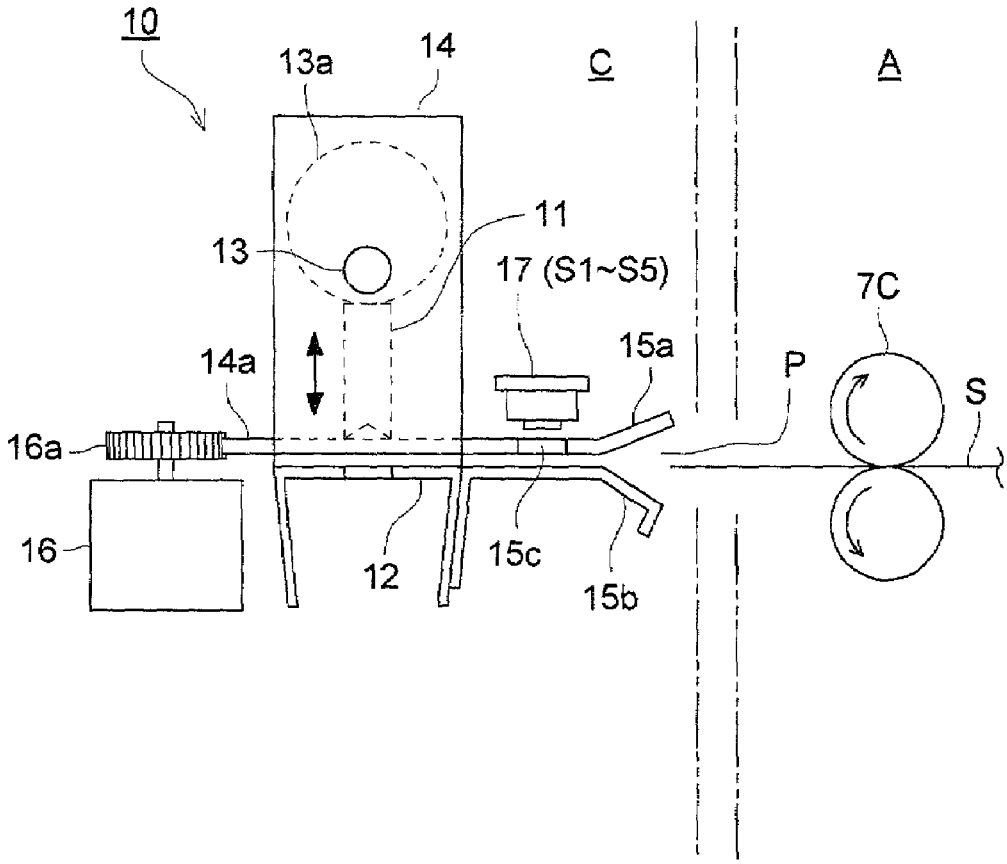
FIG. 3 is a side view showing a schematic structure of a hole-punching device.

Details of the hole-punching device 10 are shown in FIG. 2 and FIG. 3. FIG. 2 is a top view of the hole-punching device 10 and FIG. 3 is a side view thereof.

The hole-punching device 10 has therein punching blades 11 in an appropriate quantity (two pieces in the illustration) which are arranged in the direction perpendicular to the conveyance direction for sheet S and are movable vertically (shown with an arrow in FIG. 3) and die 12 that is arranged under the punching blades 11 to face it with conveyance path P for sheet S between.

Above the punching blade 11, rotary shaft 13 that is driven to rotate by an unillustrated driving means is provided horizontally on housing 14 to be in the direction perpendicular to the conveyance direction for sheet S, and on the rotary shaft 13, there is provided cam 13*a* in a way that the cam is brought into contact with an upper end of the punching blade 11. Incidentally, the punching blade 11 is urged by an unillustrated urging means so that its upper end may be brought into contact with the cam 13*a*. By virtue of this, when the rotary shaft 13 rotates, the upper end of the punching blade 11 slides on the cam surface of the cam 13*a* to press the punching blade 11 down simultaneously toward die 12 by an action of the cam 13*a*, and when sheet S fed in conveyance path P of hole-punching processor C by sheet ejection roller 7C of image forming apparatus main body A is stopped temporarily, a punched-hole is formed on the trailing edge side of sheet S in its conveyance direction.

Under the punching blade 11, there is provided upper guide plate 15*a* along the upper side of conveyance path P for sheet S, and under the punching blade 11, there is provided lower guide plate 15*b* at the upstream side of die 12 in the conveyance direction for sheet S, and these upper guide plate 15*a* and lower guide plate 15*b* which are arranged to face each other to interpose conveyance path P vertically from the upper side and from the lower side make the sheet S conveyed by sheet ejection roller 7C of the image forming apparatus main body A to be guided smoothly to the conveyance path P.

In the hole-punching device 10, punching blade 11, die 12, rotary shaft 13 and guide plates 15*a* and 15*b* are structured to be solid with the same casing 14, and rack gear 14*a* is attached on one end of the casing 14. The rack gear 14*a* is engaged with pinion gear 16*a* provided on drive motor 16, and when the drive motor 16 rotates regularly and inversely for driving, the driving force is transmitted to the casing 14 through pinion gear 16*a* and rack gear 14*a*, and in virtue of this, the total hole-punching device 10 is made to be movable in the direction (arrowed direction shown in FIG. 2) perpendicular to the conveyance direction for sheet The numeral 17 represents a sheet side edge detection means for detecting a position of a side edge that is in parallel with the conveyance direction for sheet S. This sheet side edge detection means 17 is composed of reflection-type photo-sensors S1–S5, and a plurality of them (five means in the illustration) are attached on upper guide plate 15*a* in the direction perpendicular to the conveyance direction for sheet S so that they may correspond to widths of sheets in various sizes to be subjected to hole-punching processing. Therefore, when moving the total hole-punching device 10 for the detection of the sheet side edge stated later, an amount of the movement can be made small, and efficiency of hole-punching processing can be improved.

The sheet side edge detection means 17 is made by drive of drive motor 16 to be capable of moving together with hole-punching device 10. In virtue of this, the punching blade 11 is arranged at the central position of the sheet width, even when the size (length in the lateral direction) of the sheet is changed. Incidentally, in the present embodiment shown here, each of sensors S1–S5 is set to come to an ideal position of sheet S in each size, namely, to a position that is away from a side edge on one side by 5 mm toward an inner side, in the unprejudiced position, and the invention is not limited this, and each sensor has only to be arranged to come to the position in the vicinity of an inner side or of an outer side of side edge on one side for each sheet size. Further, the number of sensors does not always need to correspond to all sheet sizes which can be processed by the apparatus, and the number less than that is also acceptable, and at least one can function.

On the upper guide plate 15*a,* there is formed opening 15*c* to correspond to each of sensors S1–S5, and each of sensors S1–S5 projects light on lower guide plate 15*b* through the opening 15*c,* and thereby, the side edge section of sheet S is detected by strength and weakness of the reflected light. Namely, when hole-punching device 10 moves in the arrowed direction in FIG. 2, sheet side edge detection means 17 (either of sensors S1–S5) that corresponds to the size of sheet S provided on the upper guide plate 15*a* crosses the side edge on one side of the sheet S from the inner side to the outer side (or, from the outer side to the inner side), and thereby, a position of the side edge of the sheet S can be detected by strength and weakness of the reflected light in this case.

By fixing the direction in which the sheet side edge detection means 17 crosses a side edge portion on one side of sheet S from the inner side to the outer side (or, from the outer side to the inner side), it is possible to minimize detection errors, which is an advantageous point. Namely, when a position of the side edge is detected by the same detection means, if an occasion to cross from the inner side to the outer side and an occasion to cross from the outer side to the inner side are present as a mixture, detected positions usually tend to be different each other. However, in the present embodiment, this problem can be solved.

Further, the sheet side edge detection means 17 can also detect the trailing edge of the sheet S by detecting passage of the trailing edge of the sheet S conveyed through conveyance path P. For the detection of the trailing edge of the sheet S, it is preferable to use innermost sensor S5 among a plurality of sensors S1–S5. Since the innermost sensor S5 is close to the central portion of sheet S, positional deviation of a punched-hole from the trailing edge of the sheet S for the conveyance direction of sheet S can be controlled to be small, when the sheet S is skewed, which is a merit. Further, for all sheet sizes, trailing edge can be detected in common.

Further, it is also possible to detect the leading edge of the sheet P by detecting passage of the leading edge of sheet P that is conveyed through conveyance path P by the sheet side edge detection means 17. As a means to detect the leading edge of a sheet in the invention, it is preferable, because of low cost, to use sensor S5 as a sensor, although a sensor may be provided separately.

Hole-punching processor C is composed of hole-punching device 10, first conveyance path 20 through which the sheet on which a punched-hole is punched and formed by the hole-punching device 10 is conveyed and ejected almost linearly through a shorter conveyance path, second conveyance path 30 for conveying and ejecting through a longer conveyance path that is curved to be in an inversed U shape, switching guide member 40 representing a switching means that switches the conveyance path for sheet S selectively to the first conveyance path 20 or to the second conveyance path 30, and punch dust receiver 50 that is arranged under the hole-punching device 10 and accepts punch dust.

The hole-punching device 10 is provided with punch pins 11 in appropriate quantity which are made to conduct advancing and retreating movements by an action of a cam rotated by an unillustrated drive motor, and each sheet S conveyed continuously from image forming apparatus main body A one sheet by one sheet is stopped temporarily by the hole-punching device 10 which advances (moves downward) punch pin 11 and punches a punched-hole on the trailing edge in the conveyance direction.

Figure 4:
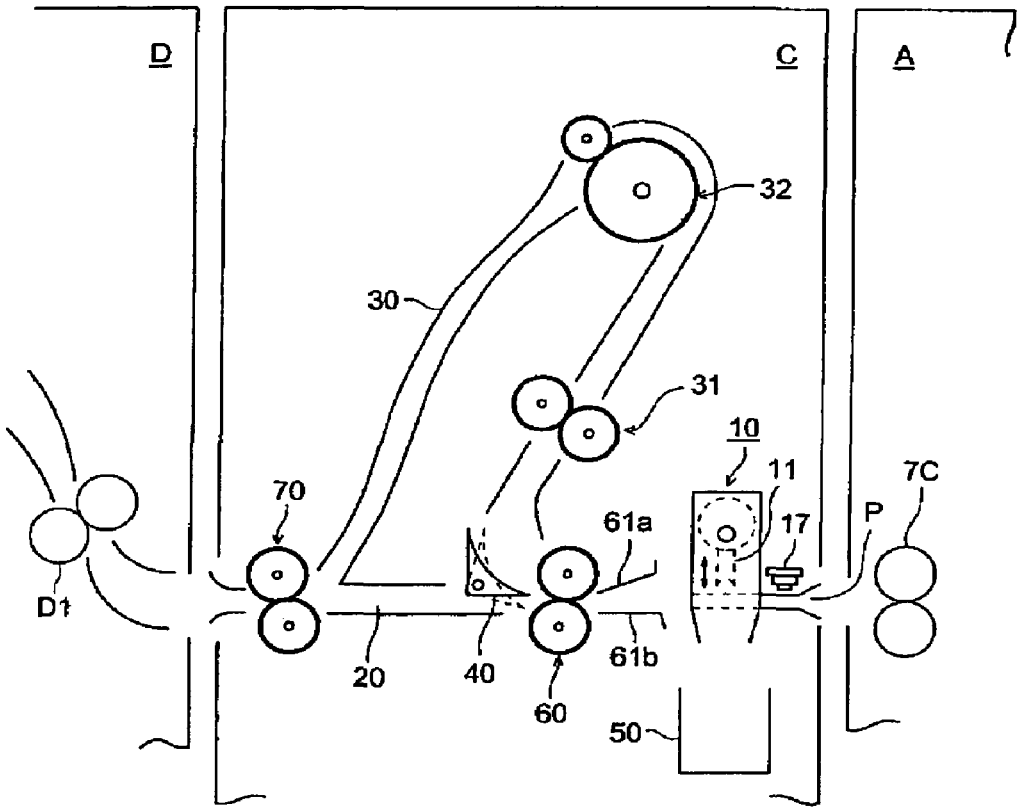
FIG. 4 is a structural diagram showing primary portions of a hole-punching processor.

Further, the hole-punching device 10 is provided to be capable of being moved by an unillustrated drive motor in the lateral direction of sheet S (direction perpendicular to the page in FIG. 4), so that a punched-hole may be punched at an appropriate position in the center of the sheet S.

On the downstream side of the holepunching device 10 in the conveyance direction, there are arranged paired registration rollers 60, and the leading edge of sheet S which has been ejected from the image forming apparatus main body A and has passed the hole-punching device 10 hits the nip formed between the paired registration rollers 60 which are in their stopped state so that a buckle of the sheet S may be formed between the upper guide plate 61*a* and the lower guide plate 61*b* both arranged at an entrance section of the paired registration rollers 60 by conveying force of sheet ejection roller 7C of the image forming apparatus main body A, and sheet skewing may be corrected. Incidentally, the numeral 17 represents a sheet side edge detection means which is integrally provided on the hole-punching device 10 and detects the leading edge and the trailing edge of the sheet S.

The switching guide member 40 is arranged at the downstream side of the paired registration rollers 60, and it functions, with the assistance of operations of an unillustrated solenoid, to switch selectively the conveyance path to the first conveyance path 20 through which the sheet S is conveyed and ejected through a shorter conveyance path that is almost linear in shape, or to the second conveyance path 30 for conveying and ejecting through a longer conveyance path that is curved to be in an inversed U shape.

The second conveyance path 30 has therein paired conveyance rollers 31 (conveyance roller 31*a* and driven roller 31*b*) for conveying sheet S along a longer conveyance path which is greatly curved and paired conveyance rollers 32 (conveyance roller 32*a* and driven roller 32*b*), and a conveyance terminal portion of the second conveyance path 30 and a conveyance terminal portion of the first conveyance path 20 join each other again, and the sheet S is ejected to the outside of the apparatus (finishing apparatus D in the subsequent step) by paired sheet ejection rollers 70 (sheet ejection roller 70*a* and driven roller 70*b*).

Figure 5:
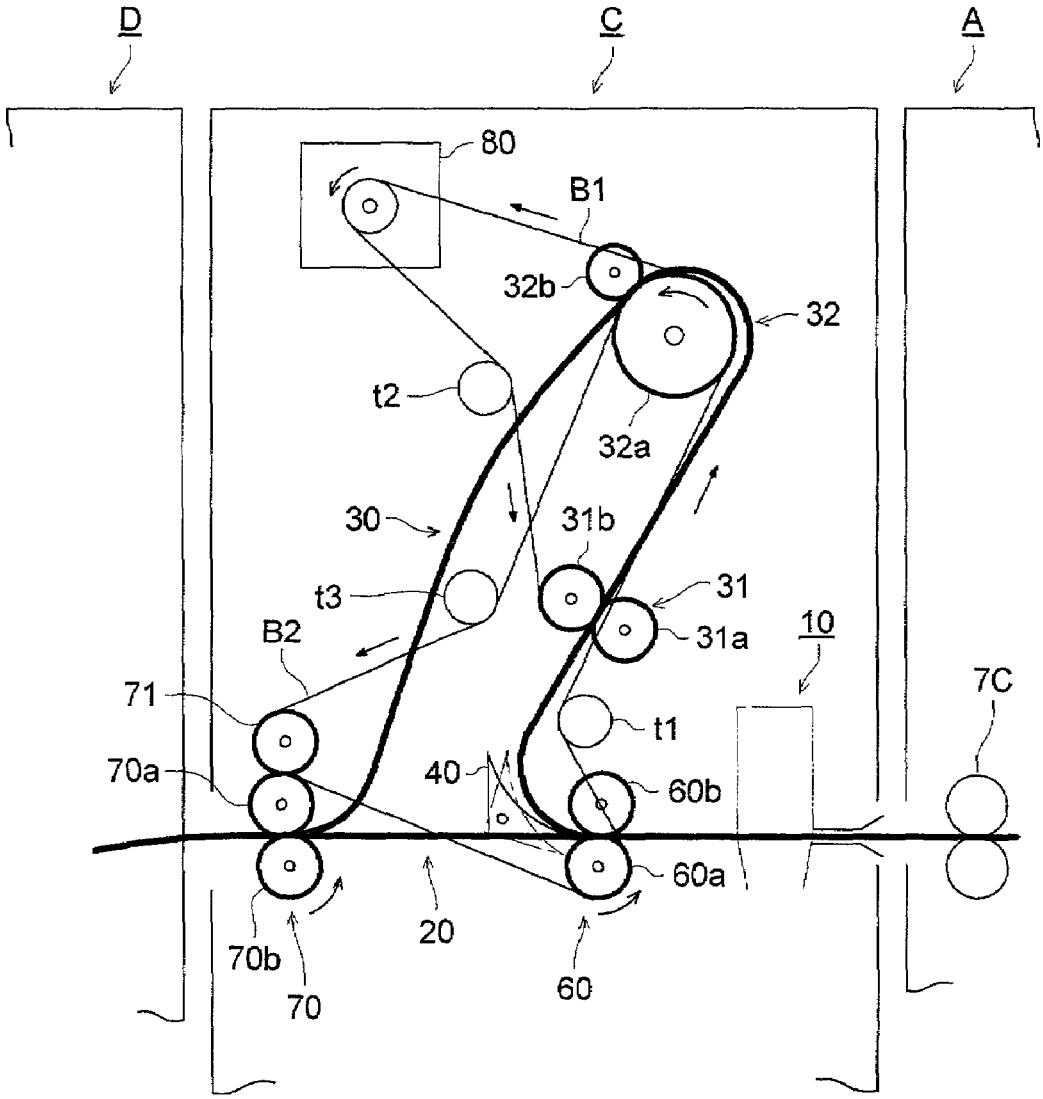
FIG. 5 is an illustration that illustrates operations of a hole-punching processor.

FIG. 5 shows a drive transmitting system of a conveyance path. As shown in the drawing, paired conveyance rollers 31 and 32, paired sheet ejection rollers 70 and paired registration rollers 60 are driven by the same conveyance motor 80 through transmission of driving force. Namely, belt B1 is trained about conveyance motor 80 and conveyance rollers 31*a* and 32*a* so that driving force of the conveyance motor 80 is transmitted, and belt B2 is trained about conveyance roller 32*a,* drive roller 60*a* of paired registration rollers 60 and transmission roller 71 that transmits driving force to sheet ejection roller 70*a* so that driving force of the conveyance motor 80 is transmitted indirectly. Incidentally, t1, t2 and t3 represent a tension roller.

In virtue of the foregoing, in the course of skew-correcting operations to make the leading edge of sheet S to hit a nip formed between paired registration rollers 60 and of hole-punching processing by hole-punching device 10, all of paired sheet ejection rollers 70, paired conveyance rollers 31 and 32 and paired registration rollers 60 are stopped by stopping the conveyance motor 80, and after a termination of the skew-correcting operations or of the hole-punching processing, all of paired sheet ejection rollers 70, paired conveyance rollers 31 and 32 and paired registration rollers 60 are driven by driving the conveyance motor 80 again, and thereby, the sheet S is conveyed to the first conveyance path 20 or the second conveyance path 30.

Incidentally, in the drive transmitting system, a oneway clutch (not shown) is used on each of driving-force transmission sections for conveyance roller 31*a,* conveyance roller 32*a* and sheet ejection roller 70*a* which are driven to rotate by drive force transmitted thereto from conveyance motor 80 by belt B1, belt B2 or transmission roller 71. This one-way clutch is arranged in a way that it transmits drive force of conveyance motor 80 to conveyance rollers 31 and 32 and to sheet ejection roller 70*a* so that sheet S in conveyance path 20 or in conveyance path 30 may be conveyed, and it is arranged so that it may run idle when external force is applied thereon in the same direction as in the direction of rotation for the conveyance when drive for the conveyance motor 80 is stopped and conveyance of sheet S is stopped accordingly. Therefore, even when drive for the conveyance motor 80 is stopped and conveyance of sheet S is stopped accordingly, sheet S itself can be drawn out in the conveyance direction.

For sheet S ejected from hole-punching processor C, the finishing apparatus D connected to the subsequent step of the hole-punching processor C conducts finishing processing such as stapling process or sorting process, depending on its function. Incidentally, in FIG. 4, D1 represents paired entrance rollers arranged on finishing apparatus D to accept sheet S ejected from the hole-punching processor C.

In the hole-punching processor C related to the invention, the conveyance path can be switched selectively by switching guide member 40 to the first conveyance path 20 to convey sheet S through a shorter conveyance path or to the second conveyance path 30 to convey through a longer conveyance path. Therefore, when the sheet S conveyed from the image forming apparatus main body A is in short in size, for example, or when a sheet in a non-hole-punching mode is conveyed, or further, when a sheet like a thick sheet which cannot be conveyed through the curved conveyance path is conveyed, the switching guide member 40 switches to the first conveyance path 20 for sheet ejection, and thus, reliability for conveyance of the sheet is secured, and quick ejection of the sheet can be realized.

Further, when sheet S which is conveyed from the image forming apparatus main body A to the hole-punching processor C and is subjected to hole-punching processing is longer than the sheet S stated above, hole-punching processing can be conducted by switching the switching guide member 40 to the second conveyance path 30 side.

Incidentally, "the sheet that is shorter in size" in the invention means a sheet having a length with which the leading edge of the sheet is not nipped by paired entrance rollers D1 on the finishing apparatus D despite the temporally stop of hole-punching processing when the sheet is conveyed through the first conveyance path 20, while, "the sheet that is longer in size" means a sheet having a length with which the leading edge of the sheet positioned at the upstream side is nipped by paired entrance rollers D1 on the finishing apparatus D when the hole-punching processing is stopped temporarily when the sheet is conveyed through the first conveyance path 20.

Operations of the hole-punching processor C will be explained as follows.

Figure 6:
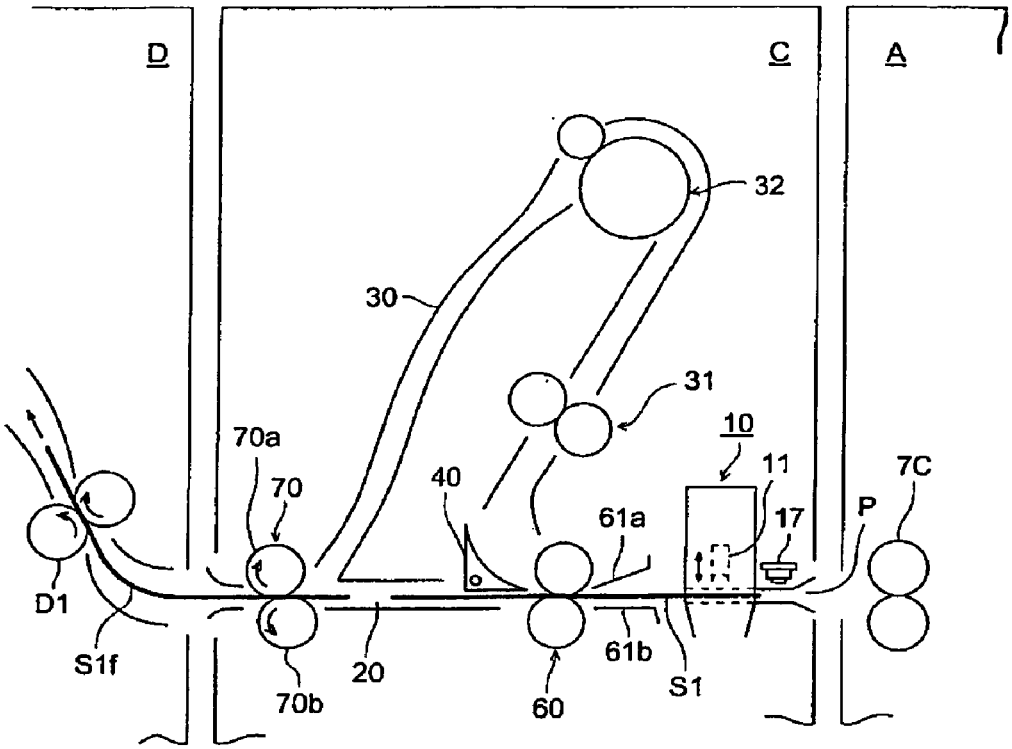
FIG. 6 is an illustration that illustrates operations of a hole-punching processor.

First, the switching guide member 40 is switched so that sheet S1 may be guided to the first conveyance path 20, when hole-punching processing is conducted on sheet S1 that is conveyed from the image forming apparatus main body A and is shorter in size, as shown in FIG. 6.

When the leading edge of the sheet S1 is detected by sheet side edge detection means 17 that is provided on the holepunching device 10, the conveyance motor 80 stops driving immediately, and thereby, paired conveyance rollers 31 and 32, paired sheet ejection rollers 70 and paired registration rollers 60 are all stopped.

The sheet S1 guided to conveyance path P is made to hit the nip formed between the paired registration rollers 60 which are arranged at the downstream side of the hole-punching device 10 and are in their stopped state, by conveying force of sheet ejection roller 7C of the image forming apparatus main body A, and sheet skewing is corrected. By virtue of this, conveyance skewing of the sheet S1 is corrected, then, the drive of the conveyance motor 80 is started again after passage of a prescribed period of time, and the paired registration rollers 60 are rotated to convey the sheet Si in the first conveyance path 20.

Then, when the trailing edge of the sheet S1 is detected by sheet side edge detection means 17 provided on the hole-punching device 10, the drive of the conveyance motor 80 is stopped again after passage of a prescribed period of time, then, the sheet S1 is stopped temporarily, and the holepunching device 10 conducts advancing and retreating movements for punch pins 11 at an appropriate position at the center of the sheet S1 and conducts holepunching processing to punch a punched-hole on the sheet S1.

When the sheet S1 is stopped temporarily in the course of hole-punching processing, the preceding sheet S1*f* also stops because of the stop of paired sheet ejection rollers 70 as shown in FIG. 6. Even when the leading edge of the sheet S1*f* is nipped by paired entrance rollers D1 of the finishing apparatus D connected to the subsequent step, and tension force is applied to the sheet, sheet ejection roller 70 can run idle in the conveyance direction for the sheet S1*f* because a one-way clutch is used on the driving-force transmission section of the sheet ejection roller 70*a,* and the sheet S1*f* can be ejected quickly from hole-punching processor C by the rotation of paired entrance rollers D1 of the finishing apparatus D without pulling each other with paired sheet ejection rollers 70 of the hole-punching processor C.

Figure 7:
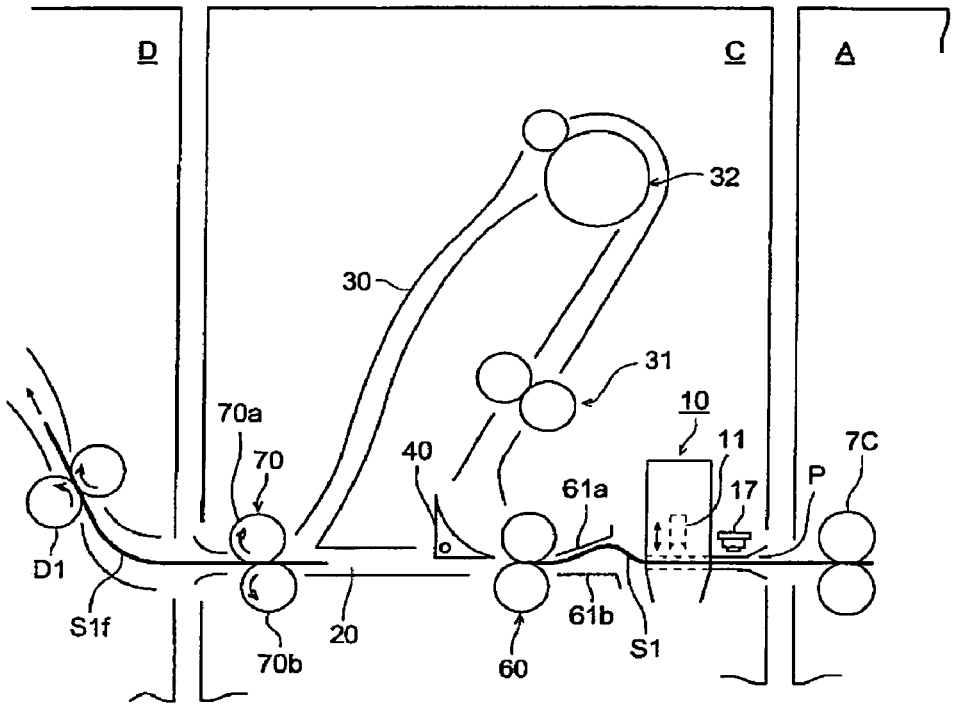
FIG. 7 is an illustration that illustrates operations of a hole-punching processor.

The action of this kind is conducted in the same way as in the foregoing, even when sheet S1 stops temporarily in the course of skew correcting operations. Namely, when the leading edge of sheet S1 conveyed in the hole-punching processor C is detected by sheet side edge detection means 17 as shown in FIG. 7, the conveyance motor 80 stops driving immediately, and thereby, paired conveyance rollers 31 and 32, paired sheet ejection rolls 70 and paired registration rollers 60 are all stopped accordingly, and the leading edge of the sheet S1 hits the paired registration rollers 60, thus, conveyance force of sheet ejection roller 7C of the image forming apparatus main body A is used for skew correcting operations. In this case, sheet S1f preceding in the first conveyance path 20 is also stopped simultaneously by the stop of the paired sheet ejection rollers 70. In this case, even when the leading edge of the sheet S1f is nipped by paired entrance rollers D1 of finishing apparatus D connected to the subsequent step, and tension force is applied accordingly, sheet ejection roller 70 can run idle in the conveyance direction for the sheet S1*f* because a one-way clutch is used on the driving-force transmission section of the sheet ejection roller 70*a*, and the sheet S1*f* can be ejected quickly from hole-punching processor C by the rotation of paired entrance rollers D1 of the finishing apparatus D without pulling each other paired sheet ejection rollers 70 of the hole-punching process C.

Figure 8:
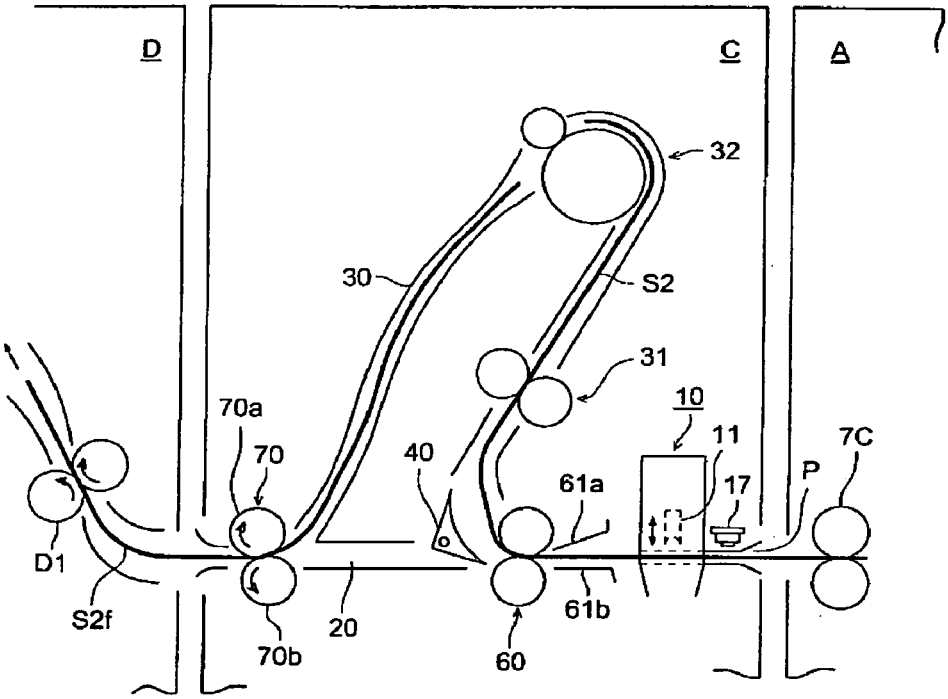
FIG. 8 is an illustration that illustrates operations of a hole-punching processor.

Next, the switching guide member 40 is switched so that sheet S2 may be guided to the second conveyance path 30, when hole-punching processing is conducted on sheet S2 that is conveyed from the image forming apparatus main body A and is longer in size, as shown in FIG. 8.

When the leading edge of the sheet S2 is detected by sheet side edge detection means 17 that is provided on the hole-punching device 10, the conveyance motor 80 stops driving immediately, and thereby, paired convance rollers 31 and 32, paired sheet ejection rollers 70 and paired registration rollers 60 are all stopped.

The sheet S2 guided to conveyance path P is made to hit the nip formed between the paired registration rollers 60 which are arranged at the downstream side of the hole-punching device 10 and are in their stopped state, by conveying force of sheet ejection roller 7C of the image forming apparatus main body A, and sheet skewing is corrected. By virtue of this, conveyance skewing is corrected, then, the drive of the conveyance motor 80 is started again after passage of a prescribed period of time, and the paired registration rollers 60 and paired conveyance rollers 31 and 32 are rotated to convey the sheet S2 in the second conveyance path 30.

Then, when the trailing edge of the sheet S2 is detected by sheet side edge detection means 17 provided on the hole-punching device 10, the drive of the conveyance motor 80 is stopped again after passage of a prescribed period of time, then, the sheet S2 is stopped temporarily, and the hole-punching device 10 conducts advancing and retreating movements for punch pins 11 at an appropriate position at the center of the sheet S2 and conducts hole-punching processing to punch a punched-hole on the sheet S2.

When the sheet S2 is stopped temporarily in the course of hole-punching processing, the preceding sheet S2*f* also stops because of the stop of paired conveyance rollers 31 and 32 and paired sheet ejection rollers 70 as shown in FIG. 7. Even when the leading edge of the sheet S2*f* is nipped by paired entrance rollers D1 of the finishing apparatus D connected to the subsequent step, and tension force is applied to the sheet accordingly, paired conveyance rollers 31 and 32 and paired sheet ejection rollers 70 can run idle in the conveyance direction for the sheet S2*f* because a oneway clutch is used on the driving-force transmission section of the conveyance rollers 31*a* and 32*a* and sheet ejection roller 70*a,* and the sheet S2*f* can be ejected quickly from hole-punching processor C by the rotation of paired entrance rollers D1 of the finishing apparatus D without pulling each other with paired sheet ejection rollers 70 of the hole-punching processor C and with paired conveyance rollers 31 and 32.

Figure 9:
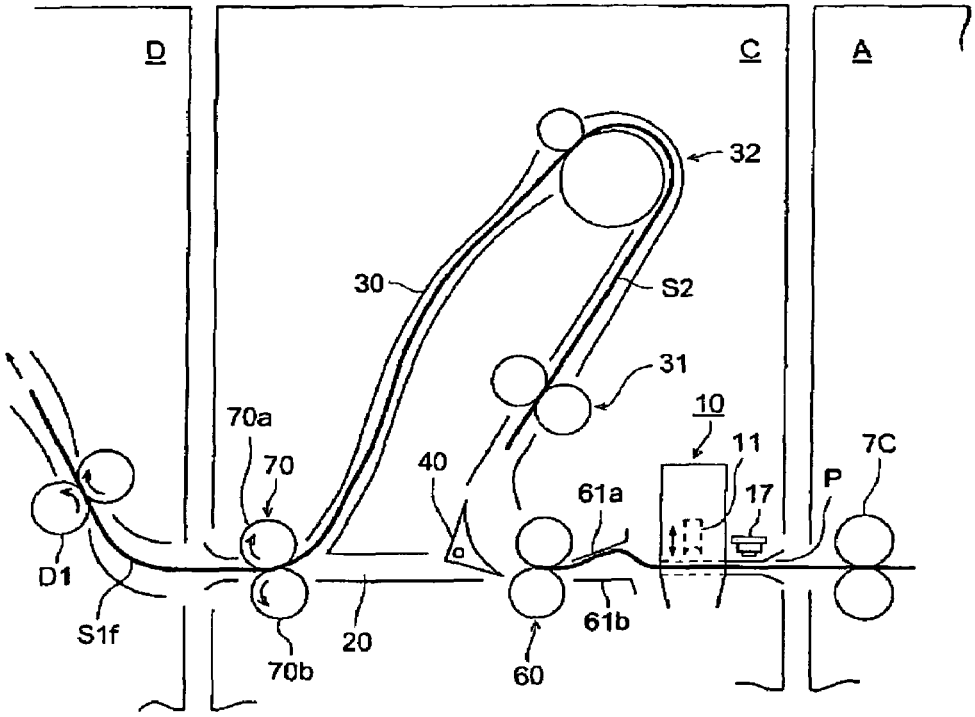
FIG. 9 is an illustration that illustrates operations of a hole-punching processor.

The action of this kind is conducted in the same way as in the foregoing, even when sheet S2 stops temporarily in the course of skew correcting operations. Namely, when the leading edge of sheet S2 conveyed in the holepunching processor C is detected by sheet side edge detection means 17 as shown in FIG. 9, the conveyance motor 80 stops driving immediately, and thereby, paired conveyance rollers 31 and 32, paired sheet ejection rolls 70 and paired registration rollers 60 are all stopped accordingly, and the leading edge of the sheet S2 hits the paired registration rollers 60, thus, conveyance force of sheet ejection roller 70 of the image forming apparatus main body A is used for skew correcting operations. In this case, sheet S2*f* preceding in the second conveyance path 30 is also stopped simultaneously by the stop of the paired sheet ejection rollers 70. In this case, even when the leading edge of the sheet S2*f* is nipped by paired entrance rollers D1 of finishing apparatus D connected to the subsequent step, and tension force is applied accordingly, paired conveyance rollers 31 and 32 and paired sheet ejection rollers 70 can run idle in the conveyance direction for the sheet S2*f* because a one way clutch is used on the drivingforce transmission section of the conveyance rollers 31*a* and 32*a* and the sheet ejection roller 70*a*, and the sheet S2*f* can be ejected quickly from hole-punching processor C by the rotation of paired entrance rollers D1 of the finishing apparatus D without pulling each other with paired sheet ejection rollers 70 of the holepunching processor C and paired conveyance rollers 31 and 32.

Incidentally, when hole-punching processing is not conducted on a sheet conveyed from the image forming apparatus main body A, even in the case of a sheet that is longer in size, switching guide member 40 is switched to guide the sheet to the first conveyance path 20 side, and without stopping conveyance motor 80, and without conducting skew correcting operations accordingly, the sheet is conveyed in the first conveyance path 20 as it is, so that the sheet is ejected out of hole-punching processor C quickly. This makes it possible eject the sheet to the finishing apparatus D in the subsequent step with less waiting time.

Next, hole-punching operations of the hole-punching processor C will be explained.

When sheet S on which a prescribed image has been recorded and formed in image forming apparatus main body A is conveyed to the hole-punching processor C, the leading edge of the sheet S is guided, from a space between upper guide plate 15*a* and lower guide plate 15*b,* to conveyance path P of hole-punching device 10 which is kept in a stand-by condition at the standard position determined in advance. The sheets which has been guided to the conveyance path P hits a nip formed between paired registration rollers 60 which are arranged at the downstream side of the hole-punching device 10 and are in their stopped state, to be corrected in terms of conveyance skewing, and is conveyed to the first conveyance path 20 or the second conveyance path 30 when the paired registration rollers 60 starts rotating.

Figure 10:
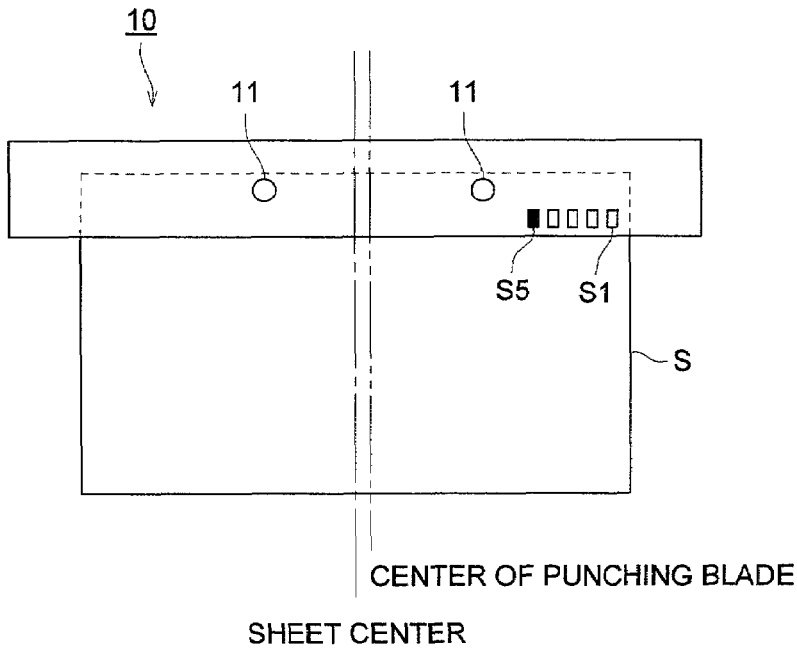
FIG. 10 is an illustration showing hole-punching operations by a hole-punching device.
Figure 11:
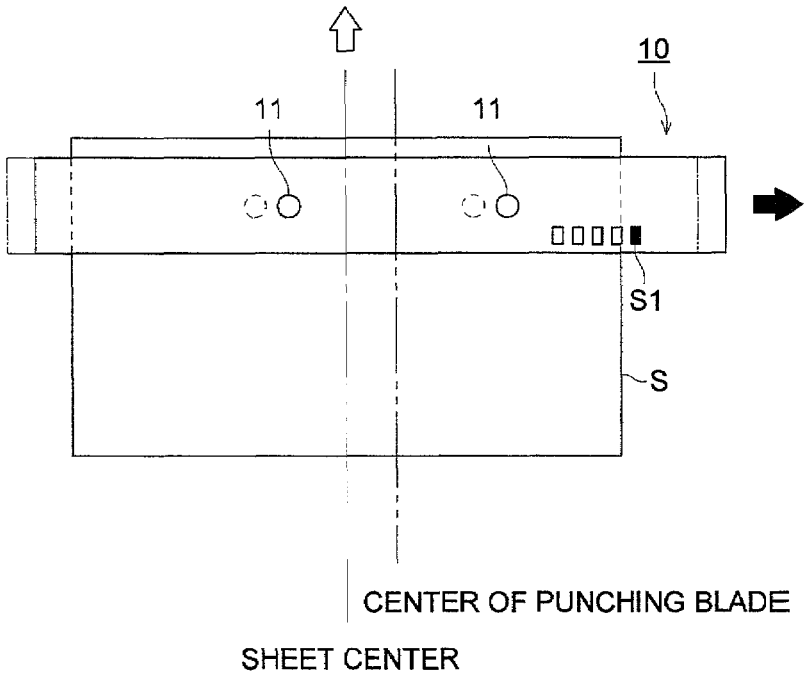
FIG. 11 is an illustration showing hole-punching operations by a hole-punching device.

On the other hand, when passage of the leading edge of the sheet S guided to the conveyance path P is detected by innermost sensor S5 of sheet side edge detection means 17 (FIG. 10), drive motor 16 is driven while the sheet S is conveyed by the paired registration rollers 60 after a prescribed period of time (after the conveyance skewing is corrected), the total hole-punching device 10 is moved in a way that sensor S1 moves from the inside to the outside of sheet S (FIG. 11), until the sensor corresponding to the size of sheet S (in this case, the outermost sensor S1 of sheet side edge detection means 17, as an example where the size of sheet S is A3) detects a side edge of the sheet S. Incidentally, sensor S5 which has functioned as a sheet side edge detection means in FIG. 10 is prepared to be ready for detection of the sheet side edge by switching an algorithm for sheet detection, before the movement of the total hole-punching device 10 is started.

Figure 12:
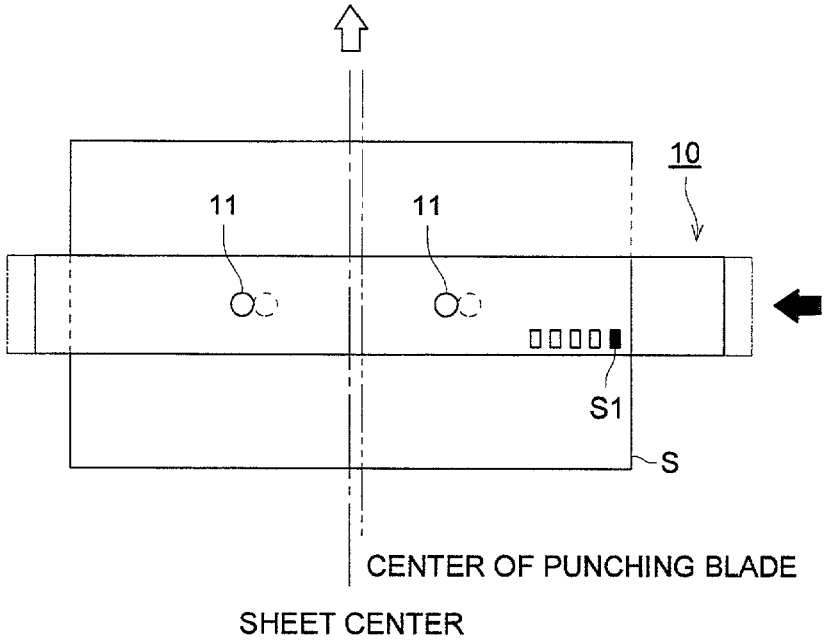
FIG. 12 is an illustration showing hole-punching operations by a hole-punching device.

When the side edge of sheet S is detected by the sensor corresponding to the size of sheet S (sensor S1 in this case), drive motor 16 is rotated in the inverse direction, the total hole-punching device 10 is moved in a way that sensor S1 moves from the outside to the inside of sheet S (FIG. 12), until the sensor S1 detects a side edge of the sheet S again.

Figure 13:
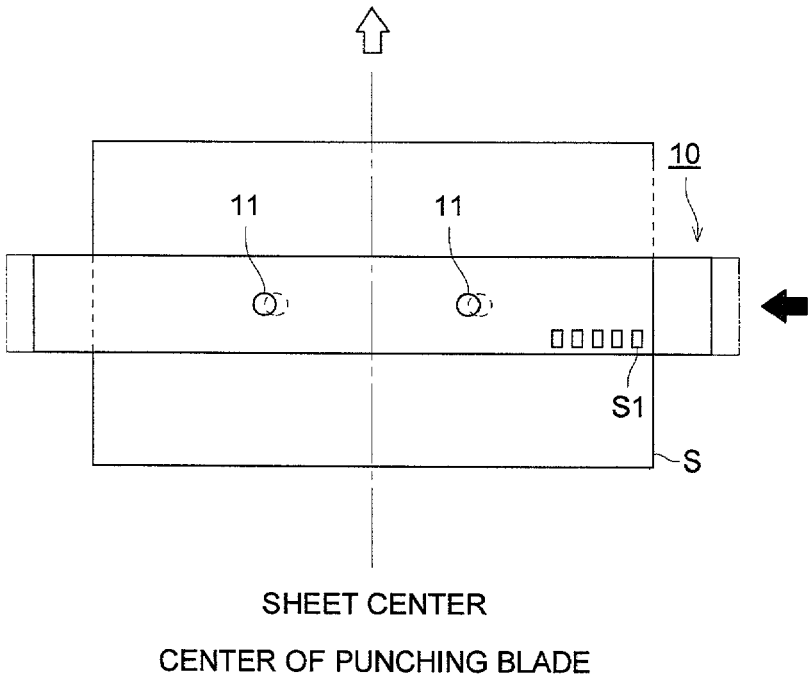
FIG. 13 is an illustration showing hole-punching operations by a hole-punching device.

After the position of the side edge of sheet S is detected, an amount of movement from the position of the side edge which makes the center of punching blade 11 of the hole-punching device 10 to agree positionally with the center of the sheet S is calculated by a computing means such as an unillustrated CPU, and thereby, drive motor 16 is controlled to move the hole-punching device 10 and punching blade 11 is positioned so that its center may agree positionally with the center of sheet S (FIG. 13).

Figure 14:
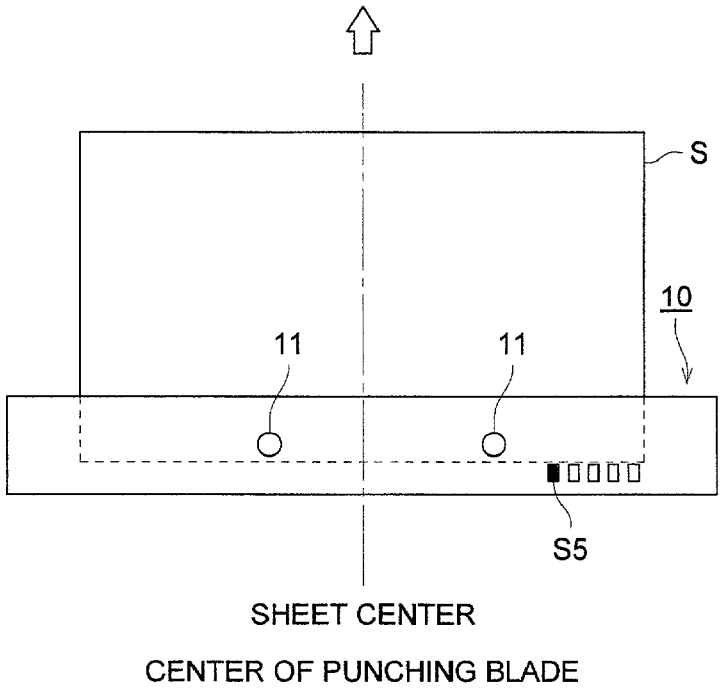
FIG. 14 is an illustration showing hole-punching operations by a hole-punching device.

Then, after the trailing edge of sheet S is detected by sensor S5 that is provided to detect the trailing edge of sheet S, the conveyance of sheet S is stopped temporarily by stopping the rotation of paired registration rollers 60 after the sheet S is conveyed for a prescribed distance, and hole-punching is conducted at a prescribed position on the sheet S by moving the punching blade 11 down at predetermined timing (FIG. 14). By virtue of this, a punched-hole can be formed accurately at the central position of sheet S.

The sheet S on which a punched-hole has been formed is conveyed when the paired registration rollers 60 start rotating again, and is ejected from the hole-punching processor C.

After that, the aforesaid operations are conducted on each sheet S.

The second embodiment of the invention will be explained as follows.

Figure 15:
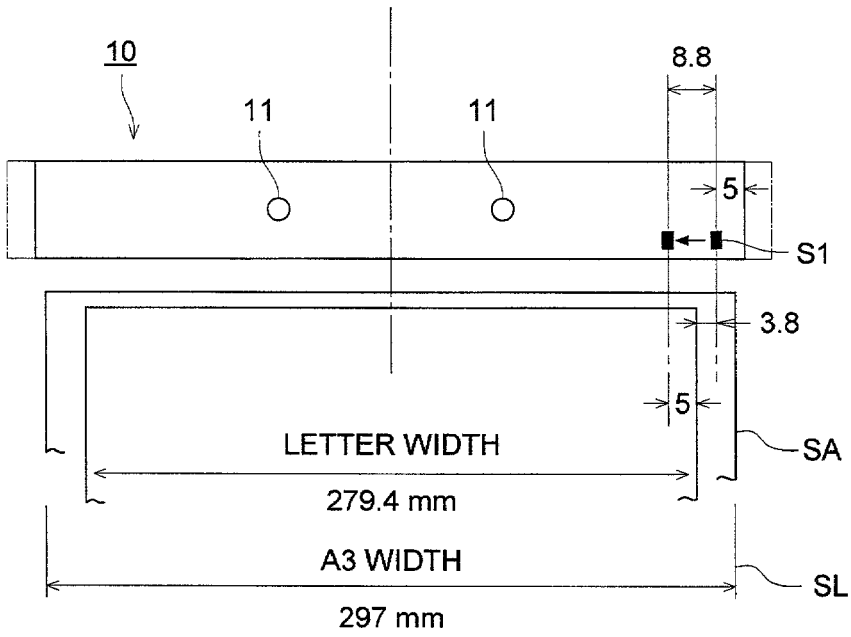
FIG. 15 is an illustration showing hole-punching operations by a hole-punching device in the second embodiment.

FIG. 15 is a top view of hole-punching device 10 in the second embodiment, and the hole-punching device 10 is structured to detect side edges for plural sheet sizes with one sensor, exemplifying that sensor S1 can detect side edge positions for A3-sized sheet $S_A$ and letter-sized sheet $S_L$. Other structures are the same as those in the aforesaid embodiment. Incidentally, each of numerical values having no unit in FIG. 15 is to be given a unit of mm.

Hole-punching operations of the hole-punching processor C of this kind will be explained as follows.

First, an occasion in the case of A3-sized sheet $S_A$ will be explained. Hole-punching device 10 stands by at the punch-center position that is the same as an ideal center of sheet $S_A$, following an unillustrated sensor for the standard position. In this case, sensor S1 is located to be inside by 5 mm from the ideal side edge position of sheet $S_A$. Incidentally, information that a sheet size is A3 is transmitted to hole-punching processor C when image forming apparatus main body A starts printing.

When sheet $S_A$ is guided through conveyance path P of hole-punching means P and when its leading edge is detected by sensor S1, the total hole-punching device 10 is moved toward the right side in the drawing by the drive of drive motor 16 in the course of conveying sheet $S_A$ after a prescribed period of time (after conveyance skewing is corrected), and then, is stopped when the side edge of the sheet $S_A$ is detected by sensor S1.

When the drive motor 16 is rotated in the inverse direction, the hole-punching device 10 moves by 5 mm toward the left side in the drawing, and stops.

After the trailing edge of sheet $S_A$ is detected by sensor S1, the sheet $S_A$ is conveyed by a predetermined distance and then, is stopped temporarily. Incidentally, this operation is conducted simultaneously with the aforesaid operation of the hole-punching device 10.

After the sheet $S_A$ is stopped temporarily, punching blade 11 is moved downward at the prescribed timing, and hole-punching is conducted at the prescribed position on sheet $S_A$. This makes it possible to form a punched-hole accurately at the central position on sheet $S_A$.

After the hole-punching is completed, the sheet $S_A$ is conveyed, and the hole-punching device 10 returns to the standard position.

Next, an occasion in the case of letter-sized sheet SL will be explained. The hole-punching device 10 moves by 8.8 mm from an unillustrated standard position toward the left side in the drawing to stand by. Namely, sensor S1 is located to be inside by 5 mm from the ideal side edge position of letter-sized sheet $S_L$. Incidentally, information that a sheet size is A3 is transmitted to hole-punching processor C when image forming apparatus main body A starts printing.

When sheet $S_L$ is guided through conveyance path P of hole-punching means P and when its leading edge is detected by sensor S1, the total hole-punching device 10 is moved toward the right side in the drawing by the drive of drive motor 16 in the course of conveying sheet $S_L$ after a prescribed period of time (after conveyance skewing is corrected).

When the side edge of the sheet $S_L$ is detected by sensor S1, the total hole-punching device 10 moves from that position toward the right side by 3.8 mm more, and stops.

After the trailing edge of sheet $S_L$ is detected by sensor S1, the sheet $S_L$ is conveyed by a predetermined distance and then, is stopped temporarily. Incidentally, this operation is conducted simultaneously with the aforesaid operation of the hole-punching device 10.

After the sheet $S_L$ is stopped temporarily, punching blade 11 is moved downward at the prescribed timing, and hole-punching is conducted at the prescribed position on sheet $S_L$. This makes it possible to form a punched-hole accurately at the central position on sheet $S_L$.

After the hole-punching is completed, the sheet $S_L$ is conveyed, and the hole-punching device 10 returns to the standard position.

Since sheet side edge detection means 17 for detecting a side edge position of sheet S is provided to be solidly with hole-punching device 10 and to be movable, hole-punching processor C can make a moving mechanism and a driving means of hole-punching device 10 serve a double purpose, without requiring a moving mechanism and a driving means for exclusive use for the sheet side edge detection means 17, resulting in attainment of a simplified apparatus. Moreover, since the sheet side edge detection means 17 is movable, it is not necessary to use a large-sized sensor like a line sensor, and a small-sized sensor can be used for detection of a side edge position of sheet S, which makes it easy to achieve a small-sized and low cost apparatus.

In the explanation above, there has been shown an example wherein a photo-sensor of a reflection type is used for sheet side edge detection means 17, to which, however, the invention is not limited. For example, it is also possible to employ a photo-sensor of a transmission type wherein a light-receiving section is arranged on lower guide plate 15*b*, and light from a light-projecting section arranged on upper guide plate 15*a* is received by the light-receiving section on the lower guide plate 15*b* with conveyance path P between.

An image forming apparatus may also be provided with a finishing apparatus for conducting further the finishing processing such as, for example, stapling and sorting.

Figure 16:
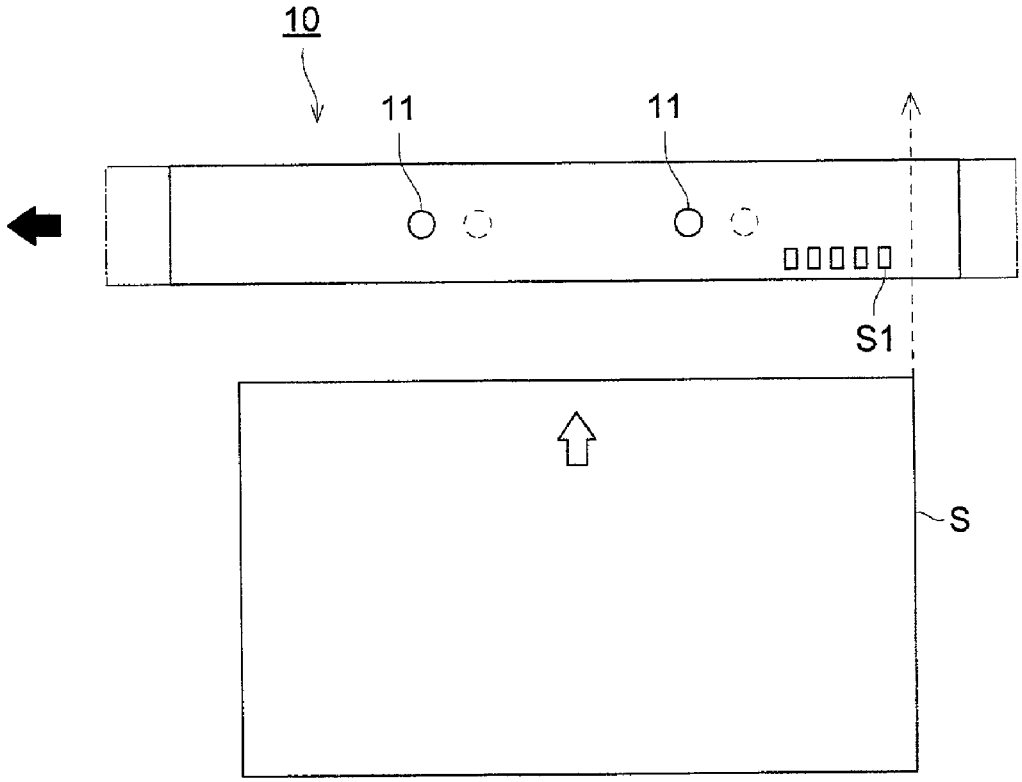
FIG. 16 is an illustration showing operations by a hole-punching device in the case of non-hole-punching processing.

On the other hand, when a non-hole-punching processing mode is selected by a setting operation on the image forming apparatus main body A side, hole-punching device 10 is moved toward inside or outside of sheet S by driving drive motor 16 to rotate in advance, before the leading edge of sheet S reaches side edge detection means 17, so that any of sensors S1–S5 of the side edge detection means 17 provided on the hole-punching device 10 may be made to stand by without interfering the side edge portion of sheet S which is conveyed in (FIG. 16).

In virtue of this, when sheet S passes under the side edge detection means 17, a side edge portion that is in parallel with the conveyance direction does not pass the space just below any of sensors S1–S5. Therefore, it is possible to avoid the passage of the sheet S through the space just below sensor holes 15*c* formed on upper guide plate 15*a* corresponding respectively to sensors S1–S5, and thus, the sheet S can be conveyed and ejected from the hole-punching device 10 without an accident that a pointed corner of sheet S is caught by the sensor hole 15*c*, which makes it possible to improve reliability of sheet conveyance.

Incidentally, in the case of non-hole-punching processing, the hole-punching device 10 is moved to stand by so that all sensors S1–S5 (total side edge detection means 17) may be positioned inside sheet S, in the embodiment shown in FIG. 10. However, it is also possible to move the hole-punching device 10 to make it to stand by so that all sensors S1–S5 (total side edge detection means 17) may be positioned outside sheet S.

Figure 17:
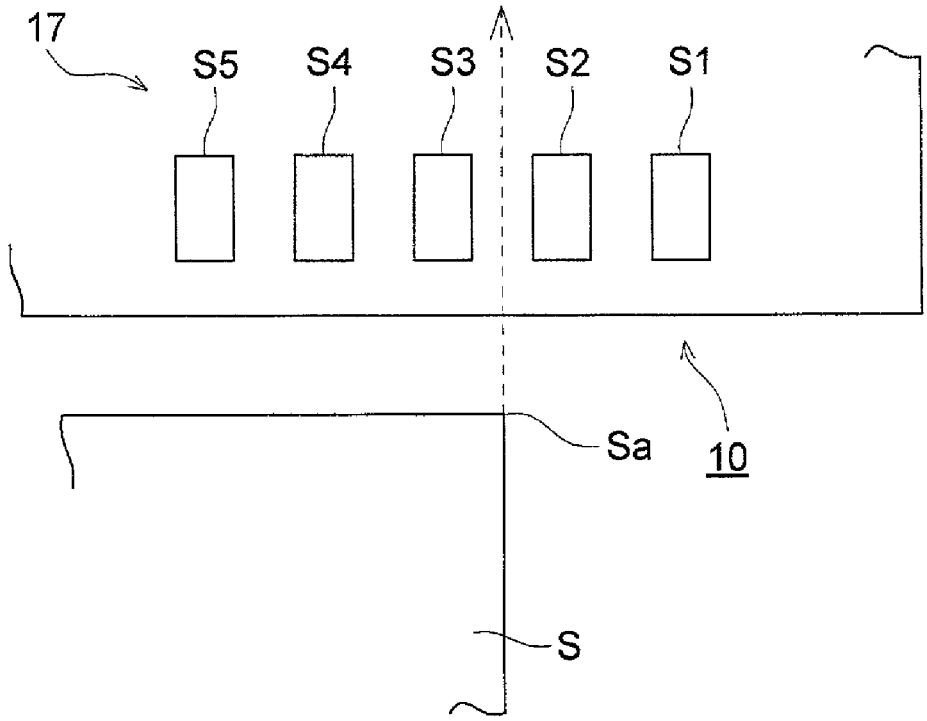
FIG. 17 is an illustration showing operations by a hole-punching device in the case of non-hole-punching processing.

When the side edge detection means 17 is composed of a plurality of sensors S1–S5 as shown in the present embodiment, it is possible to avoid that a pointed corner of sheet S passes the space just below sensor holes 15*c* even when hole-punching device 10 is moved to stand by so that a side edge portion that is in parallel with the conveyance direction for sheet S may be positioned between either two of sensors among sensors S1–S5, as shown in FIG. 17, thus, the sheet S can be conveyed and ejected from the hole-punching device 10 without any risk of the occurrence of a jam.

In the explanation above, there has been shown an example wherein a photo-sensor of a reflection type is used for side edge detection means 17, to which, however, the invention is not limited. For example, it is also possible to employ a photo-sensor of a transmission type wherein a light-receiving section is arranged on lower guide plate 15*b*, and light from a light-projecting section arranged on upper guide plate 15*a* is received by the light-receiving section on the lower guide plate 15*b* with conveyance path P between.

An image forming apparatus may also be provided with a finishing apparatus for conducting further the finishing processing such as, for example, stapling and sorting.

The invention offers the following effects.

(1) It is possible to provide a hole-punching processor wherein sheet jamming is not caused in the case of non-hole-punching processing and reliability for sheet conveyance has been improved.

(2) It is possible to provide an image forming apparatus equipped with hole-punching processor wherein sheet jamming is not caused in the case of non-hole-punching processing and reliability for sheet conveyance has been improved.

(3) It is possible to provide a hole-punching processor which can conduct hole-punching processing on the central position in the lateral direction on a sheet accurately, and can be structured at low cost with a simple structure to be small in size.

(4) It is possible to provide an image forming apparatus equipped with a hole-punching processor which can conduct hole-punching processing at the central position in the lateral direction on a sheet accurately, and can be structured at low cost with a simple structure to be small in size.

(5) It is possible to provide a hole-punching processor wherein a sheet conveyed from the image forming apparatus main body can be ejected appropriately and quickly depending on the size of that sheet and on whether hole-punching processing is required to provide an image forming apparatus equipped with the hole-punching processor.

(6) It is possible to provide a hole-punching processor wherein a sheet is not pulled each other between the hole-punching processor and a finishing apparatus and can be ejected out smoothly, when the sheet is stopped temporarily in the course of hole-punching processing, even when the finishing apparatus is further connected, and to provide an image forming apparatus equipped with the hole-punching processor.

Disclosed embodiment can be varied by a skilled person without departing from the spirit and scope of the invention.

What is claimed is:

1. An image-forming apparatus, comprising:

an image-forming section to form an image on a sheet;

an ejecting section to eject said sheet on which said image is formed; and a hole-punching processor to form a punched-hole on said sheet while conveying said sheet through said hole-punching processor;

wherein said hole-punching processor comprises:

a hole-punching device being movable in a direction perpendicular to a conveyance direction of said sheet; and a sheet-edge detector to detect a side-edge of said sheet in a direction parallel to said conveyance direction of said sheet; and wherein said sheet-edge detector is in a fixed relationship with said hole-punching device so that said hole-punching device and said sheet-edge detector move in conjunction with each other; and wherein said holepunching device moves in conjunction with said sheetedge detector in said direction perpendicular to said conveyance direction of said sheet, based on positional information of said side-edge detected by said sheet-edge detector, to punch a hole in said sheet; and wherein said sheet-edge detector includes a plurality of sheet-edge sensors, each of which corresponds to each of sheet sizes to be processed by said hole-punching processor.

2. The image-forming apparatus of claim 1, wherein, in case of a nonpunching mode in which a hole-punching action of said hole-punching device is deactivated, said sheet-edge detector is moved at a standby position located at either an inner or an outer position of said side-edge of said sheet so as to pass said sheet without punching.

3. A hole-punching processor for forming a punched-hole on a sheet residing in a conveying path for conveying said sheet through said hole-punching processor, comprising:

a hole-punching device being movable in a direction perpendicular to a conveyance direction of said sheet; and a sheet-edge detector to detect a side-edge of said sheet in a direction parallel to said conveyance direction of said sheet;

wherein said sheet-edge detector is in a fixed relationship with said hole-punching device so that said hole-punching device and said sheet-edge detector move in conjunction with each other; and wherein said hole-punching device moves in conjunction with said sheet-edge detector in said direction perpendicular to said conveyance direction of said sheet, based on positional information of said side-edge detected by said sheet-edge detector, to punch a hole in said sheet; and wherein said sheet-edge detector includes a plurality of sheet-edge sensors, each of which corresponds to each of sheet sizes to be processed by said hole-punching processor.

4. The hole-punching processor of claim 3, wherein said sheet-edge detector is disposed in a vicinity of either an inner or an outer portion of said side-edge of said sheet, and, after a leading edge of said sheet is detected, said hole-punching device moves in either an inner or an outer direction perpendicular to said conveyance direction of said sheet so that said sheet-edge detector detects a position of said side-edge of said sheet.

5. The hole-punching processor of claim 4, wherein said sheetedge detector also serves as a detector for detecting said leadingedge of said sheet.

6. The hole-punching processor of claim 5, wherein one of said sheet-edge sensors, which is disposed at a position nearest to a center of said sheet, detects said leading-edge of said sheet.

7. The hole-punching processor of claim 3, further comprising:

a trailing-edge detector to detect ling-edge of said sheet being conveyed;

wherein an action for conveying said sheet is temporarily deactivated, when said sheet has moved for a predetermined distance since said trailingedge detector detected said trailing-edge of said sheet.

8. The hole-punching processor of claim 7, wherein said sheet-edge detector also serves as said trailing-edge detector.

9. The hole-punching processor of claim 8, wherein a one of said sheet-edge sensors, which is disposed at a position nearest to a center of said sheet, detects said trailing-edge of said sheet.

10. A hole-punching processor of claim 3, wherein, in case of a nonpunching mode in which a hole-punching action of said hole-punching device is deactivated, said sheetedge detector is moved at a standby position located at either an inner or an outer position of said side-edge of said sheet so as to pass said sheet without punching.

11. The hole-punching processor of claim 10, wherein said sheet-edge sensors comprises either a reflection-type or a transmission-type photo-sensor.

12. The hole-punching processor of claim 3, wherein said hole-punching processor has a guide member, and said sheet-edge detector and said hole-punching device are fixed to said guide member.

* * * * *